US011306458B1

(12) United States Patent
Wells

(10) Patent No.: US 11,306,458 B1
(45) Date of Patent: Apr. 19, 2022

(54) ADJUSTABLE FOUNDATION SUPPORT BRACKET

(71) Applicant: Darin Wells, Garden Grove, CA (US)

(72) Inventor: Darin Wells, Garden Grove, CA (US)

( * ) Notice: Subject to any disclaimer, the term of this patent is extended or adjusted under 35 U.S.C. 154(b) by 0 days.

(21) Appl. No.: 17/210,358

(22) Filed: Mar. 23, 2021

(51) Int. Cl.
*E02D 35/00* (2006.01)
*E02D 37/00* (2006.01)
*E01D 19/02* (2006.01)

(52) U.S. Cl.
CPC ..... *E02D 35/005* (2013.01); *E02D 37/00* (2013.01); *E01D 19/02* (2013.01); *E02D 2200/11* (2013.01); *E02D 2600/20* (2013.01)

(58) Field of Classification Search
CPC ..... E02D 35/00; E02D 35/005
USPC ..... 405/230
See application file for complete search history.

(56) References Cited

U.S. PATENT DOCUMENTS 5,176,472 A * 1/1993 Kinder ..... E02D 27/48 405/230
5,800,094 A * 9/1998 Jones ..... E02D 35/00 254/133 R
7,182,316 B2 * 2/2007 Sykes ..... E02D 35/00 254/85
10,422,102 B1 * 9/2019 Fontaine ..... E02D 35/005
10,508,406 B1 * 12/2019 Childress ..... E02D 3/12
2002/0062622 A1 * 5/2002 Bell ..... E02D 35/00 52/741.15
2008/0170912 A1 * 7/2008 Kaufman ..... E02D 35/00 405/232
2008/0175673 A1 * 7/2008 Roberts ..... E02D 35/00 405/230
2011/0023384 A1 * 2/2011 Marshall ..... E04B 1/3511 52/125.1
2012/0255242 A1 * 10/2012 Patton ..... B66F 3/24 52/126.6
2020/0270827 A1 * 8/2020 Newcomb ..... E02D 35/005

FOREIGN PATENT DOCUMENTS

KR 20110029877 A * 3/2011 ..... E02D 7/20

* cited by examiner

*Primary Examiner* — Frederick L Lagman
(74) *Attorney, Agent, or Firm* — Aaron P. McGushion

(57) ABSTRACT

The present devices and methods provide an adjustable foundation support that rests upon the top end of a pier driven to load bearing strata, and is configured to receive a jack within the bracket of the adjustable foundation support to adjust the height of the foundation by the jack pushing down upon the pier through the pier cap and pushing upwards upon the bracket. The foundation can be adjusted by the adjustable foundation support to provide a level foundation, either alone or in cooperation with one or more additional adjustable foundation supports. Once foundation has been adjusted to the required height, the height adjustment lock is engaged to the pier cap to support the weight of the foundation through the bracket, to maintain the required height for the service life of the adjustable foundation support, with the ability to readjust the height, should that be required in the future.

16 Claims, 6 Drawing Sheets

ADJUSTABLE FOUNDATION SUPPORT BRACKET

BACKGROUND

The subject of this patent application relates generally to structural foundation repair, and more particularly, to devices for supporting foundations built upon unstable soil.

By way of background, when buildings are constructed wholly or in part on unstable soil, over time, the portion of the foundation on the unstable soil will sink, causing damage to the foundation and endangering the structural integrity of the building itself. Current solutions include the use of piers to provide a stable platform for the foundation to rest upon. Piers are driven or screwed into the ground until reaching more stable soil or load bearing strata (e.g., bedrock or the like). Push pier systems utilize the weight of the structure to drive long piers vertically down into the soil.

After the pier has been driven into the soil, the foundation must be coupled to the pier so that the weight of the foundation rests upon the pier and the final adjustments in height can be made to make the foundation level. Some of the current systems used to couple the pier to the foundation position the load offset from the pier (e.g., the load is not directly over the pier), creating an undesirable moment. Other systems require multiple points of adjustment, which increases complexity and the likelihood of failure or improper installation. What is needed is a system to couple the foundation to the pier where the load is centered over the pier and is an easy-to-use, simplified system.

Aspects of the present invention fulfill these needs and provide further related advantages as described in the following summary.

SUMMARY

Aspects of the present invention teach certain benefits in construction and use which give rise to the exemplary advantages described below.

The present specification discloses an adjustable foundation support for changing a height of a foundation and transferring at least a local portion of a foundation load to a pier. The adjustable foundation support includes a bracket, a pier cap, and a height adjustment lock. The bracket has a top plate rigidly attached to and separated from a bottom plate by a vertical support and a jack region delineated between the top plate and the bottom plate, with a pier cap opening being formed through the bottom plate. The pier cap has a jack support and a pier sleeve, where the pier sleeve extends rigidly from a bottom surface of the jack support with a pier receiving opening situated distally. The pier cap is configured to be placed through the opening of the bottom plate of the bracket with the jack support plate positioned within the jack region and the elongated pier sleeve extending through the opening. The height adjustment lock is selectively attached to the pier cap by the pier sleeve with the bottom plate of the bracket situated between the jack support plate and the height adjustment lock. In use, the height adjustment lock is configured to couple with the elongated pier sleeve located at a desired position. And, once located at the desired position, the height adjustment lock is configured to completely support the local portion of the foundation load through the bracket with the bottom plate bearing upon the height adjustment lock with a top end of the pier inserted through the pier receiving opening and situated within the elongated pier sleeve.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above-described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

The present devices and methods in one or more embodiments provides an adjustable foundation support that rests upon the top end of a pier driven to load bearing strata, and is configured to receive a jack within the bracket of the adjustable foundation support to adjust the height of the foundation by the jack pushing down upon the pier through the pier cap and pushing upwards upon the bracket. The foundation can be adjusted upwards or downwards by the adjustable foundation support to provide a level foundation, either alone or in cooperation with one or more additional adjustable foundation supports. Once foundation has be lifted or lowered to the required height, the height adjustment lock is engaged to the pier cap to support the weight of the foundation at that point through the bracket, to maintain the required height for the service life of the adjustable foundation support, with the ability to readjust the height, should that be required in the future.

Figure 1:
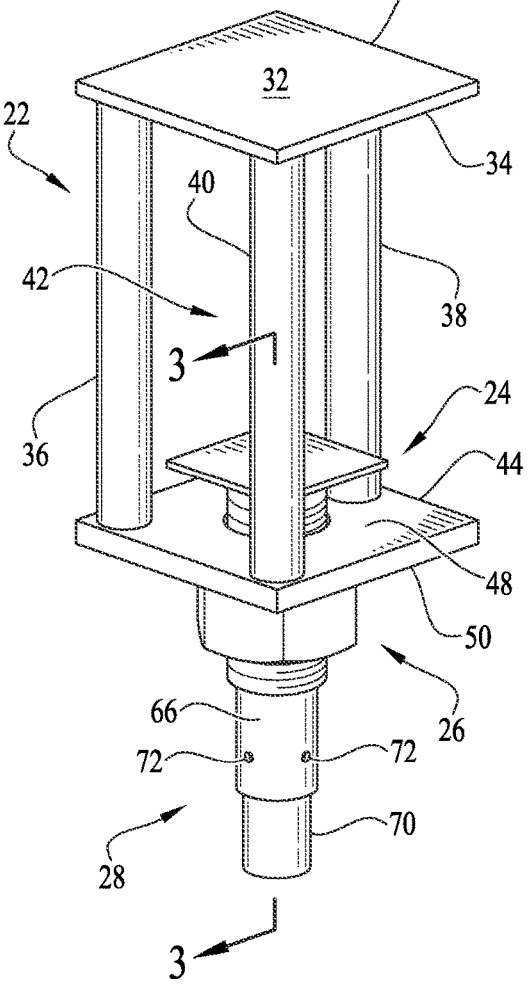
FIG. 1 is an assembled perspective view of an exemplary embodiment of the present adjustable foundation support bracket.
Figure 2:
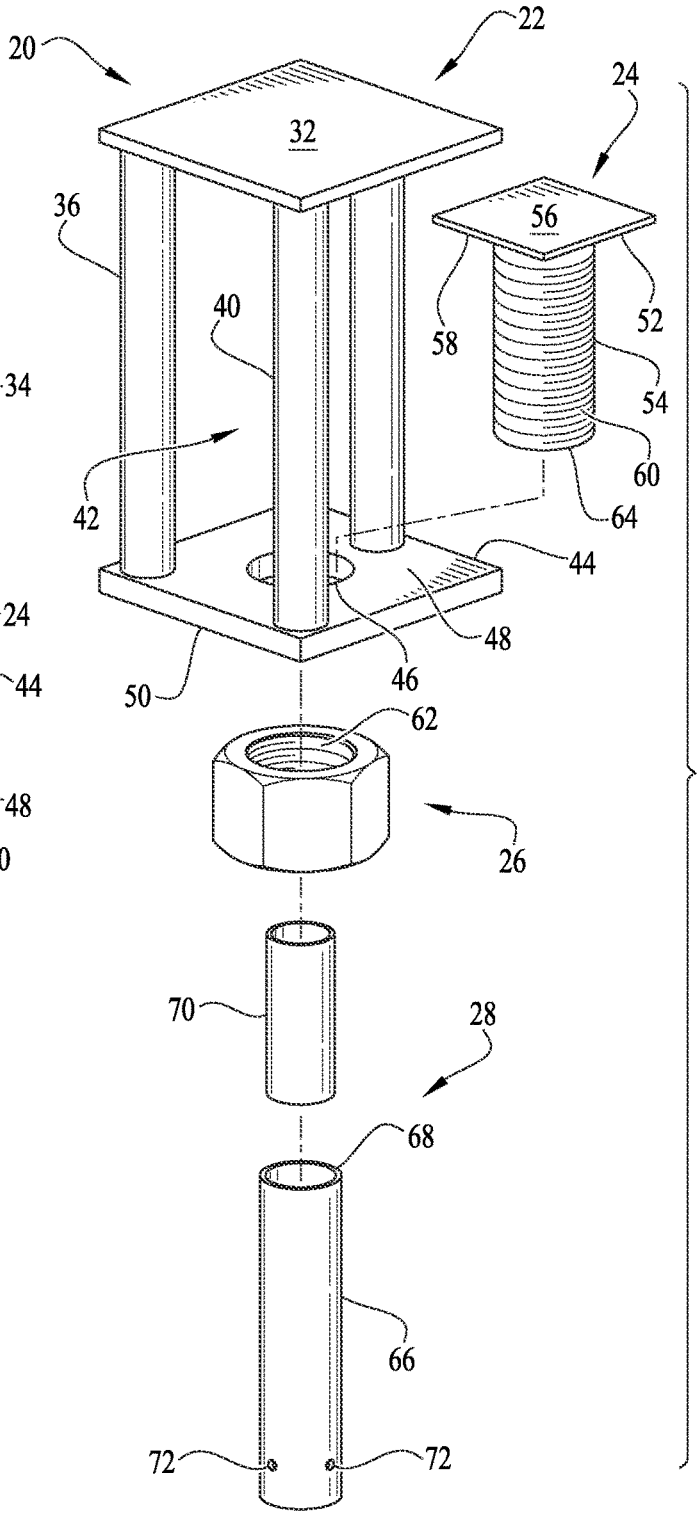
FIG. 2 is an exploded perspective view of the adjustable foundation support bracket of FIG. 1.
Figure 3:
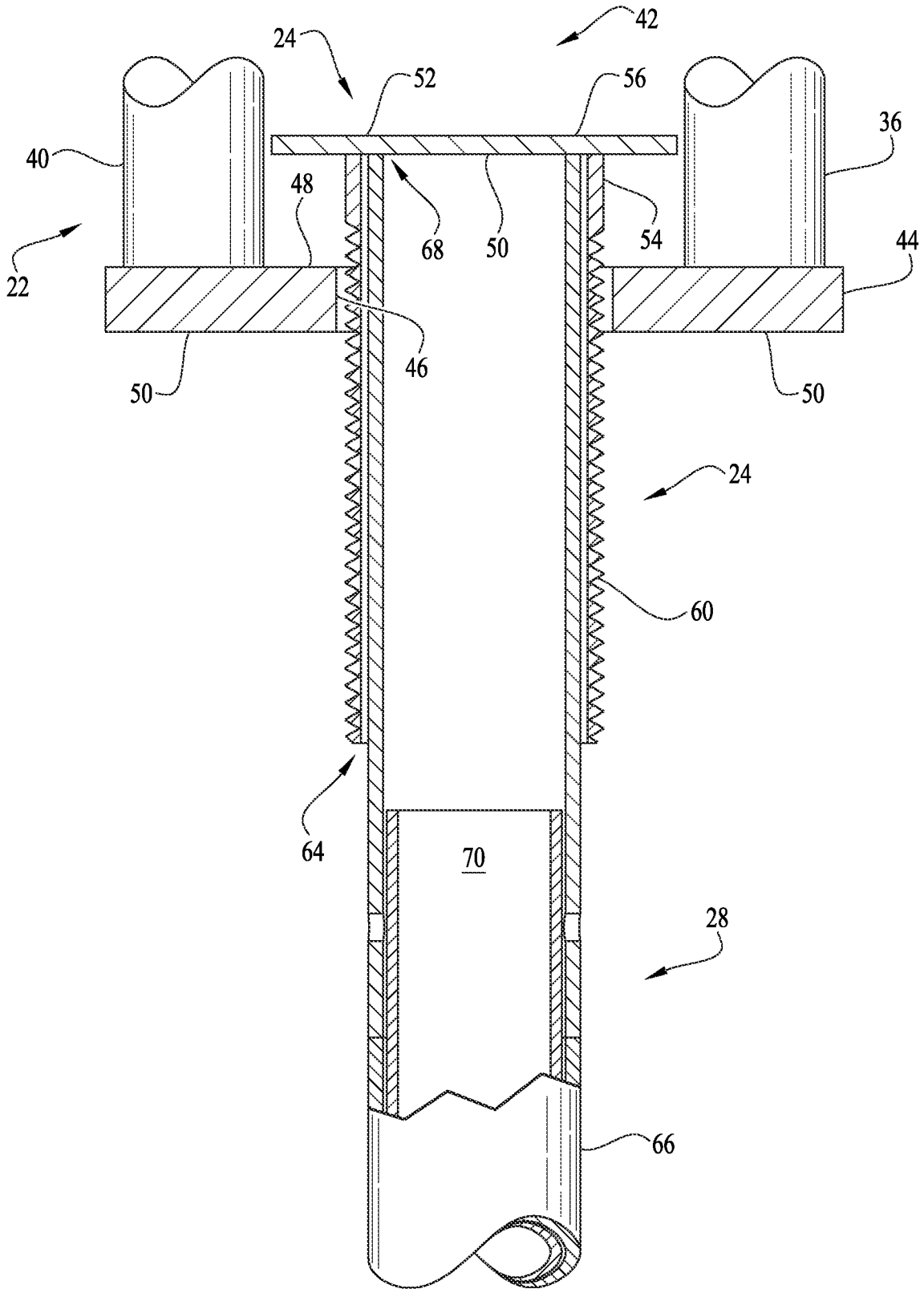
FIG. 3 is an assembled partial cross-sectional side view of the adjustable foundation support bracket of FIG. 1.

Looking first at FIGS. 1-3, an example embodiment of the present adjustable foundation support 20 is illustrated in assembled and exploded configurations, respectively. In one or more embodiments, the adjustable foundation support 20 includes a bracket 22, a pier cap 24, and a height adjustment lock 26. Looking at the construction of the exemplary bracket 22, a top plate 30 (which may also be referred to herein as a foundation support portion) is rigidly attached to and separated from a bottom plate 44 (which may also be referred to herein as a bottom support portion or a distribution plate) by a vertical support 36, 38, 40 and a jack region 42 delineated between the top plate 30 and the bottom plate 44. In the illustrated example embodiment, the top plate 30 is a square plate with a top surface 32 and a bottom surface 34. The bottom plate 44 is also a square plate with a top surface 48 and a bottom surface 50. The bottom plate 44 further includes a through hole 46 generally formed at the center of symmetry of the bottom plate 44. As will be discussed in greater detail below, the through hole 46 is sufficiently large to receive a portion of the pier cap 24 therethrough, where the portion of the pier cap 24 is larger then the nominal size of the pier 28; and the through hole is larger than the portion of the pier cap 24.

Although, terms like top plate and bottom plate are used, the structures need not be plate-shaped, unless further defined by plate-like structure, such as planar top and/or bottom surfaces. For example, the primary purpose of the top plate, in at least one embodiment, is to transmit the lifting force of the jack J to the foundation F, either directly or indirectly, where the lifting force is best distributed of a large surface area (e.g., a large, flat planar or plate portion) to protect the foundation from point loads. The shape of the top plate 30 and the bottom plate 44 may or may not be relative thin sheet of material (such as a plate of steel), and may include other structures that increase rigidity, provides locating or centering capabilities, or other design and structural features that are not plate-like in appearance.

The vertical support 36, 38, 40 may be any structure that rigidly separates the top plate 30 from the bottom plate 44 and provides support sufficient to bear the load of the foundation without substantial buckling or other structural failure. In this example embodiment, the vertical supports are three tubular columns 36, 38, 40 that are connected and vertically oriented between the top plate 30 and the bottom plate 44 by welding or other appropriate attachment means. The ends of each of the columns 36, 38, 40 are generally attached near the outer perimeters of the top plate 30 and the bottom plate 44 for stability and to provide space to insert, operate, and remove the jack J in the jack region 42. The columns are generally parallel and are set in a triangular arrangement, or an equilateral triangle in at least one embodiment. The vertical support 36, 38, 40 can be one or more plates, steel angel stock, or any number of vertical supports that provide the required structural support.

The pier cap 24 is configured to receive the outer pier top end 68 of the pier 28 within the pier sleeve 54 of the pier cap 24 (which may also be referred to herein a hollow threaded extension), such that the pier cap 24 is supported wholly atop the pier 28. The pier cap 28 includes a jack support plate 52 with a top surface 56 opposite a bottom surface 58. Extending orthogonally from the bottom surface 58 is the pier cap 24, which includes a hollow threaded extension 54 with a male thread 60 about the outer surface and an opening 64 to the hollow threaded extension 54 at a distal end. The proximal end of the hollow threaded extension 54 is welded to the bottom surface 58 of the jack support plate 52, where the bottom surface 58 defines the bottom of the hollow threaded extension 54, upon which the end 68 of the pier 28 bears. The length of the hollow threaded extension 54 is sufficient to prevent the pier cap 24 from twisting or jumping off the end 68 of the pier 28 due to stress or seismic activity, and further prevent excessive bending damage to the pier 28.

Figure 4:
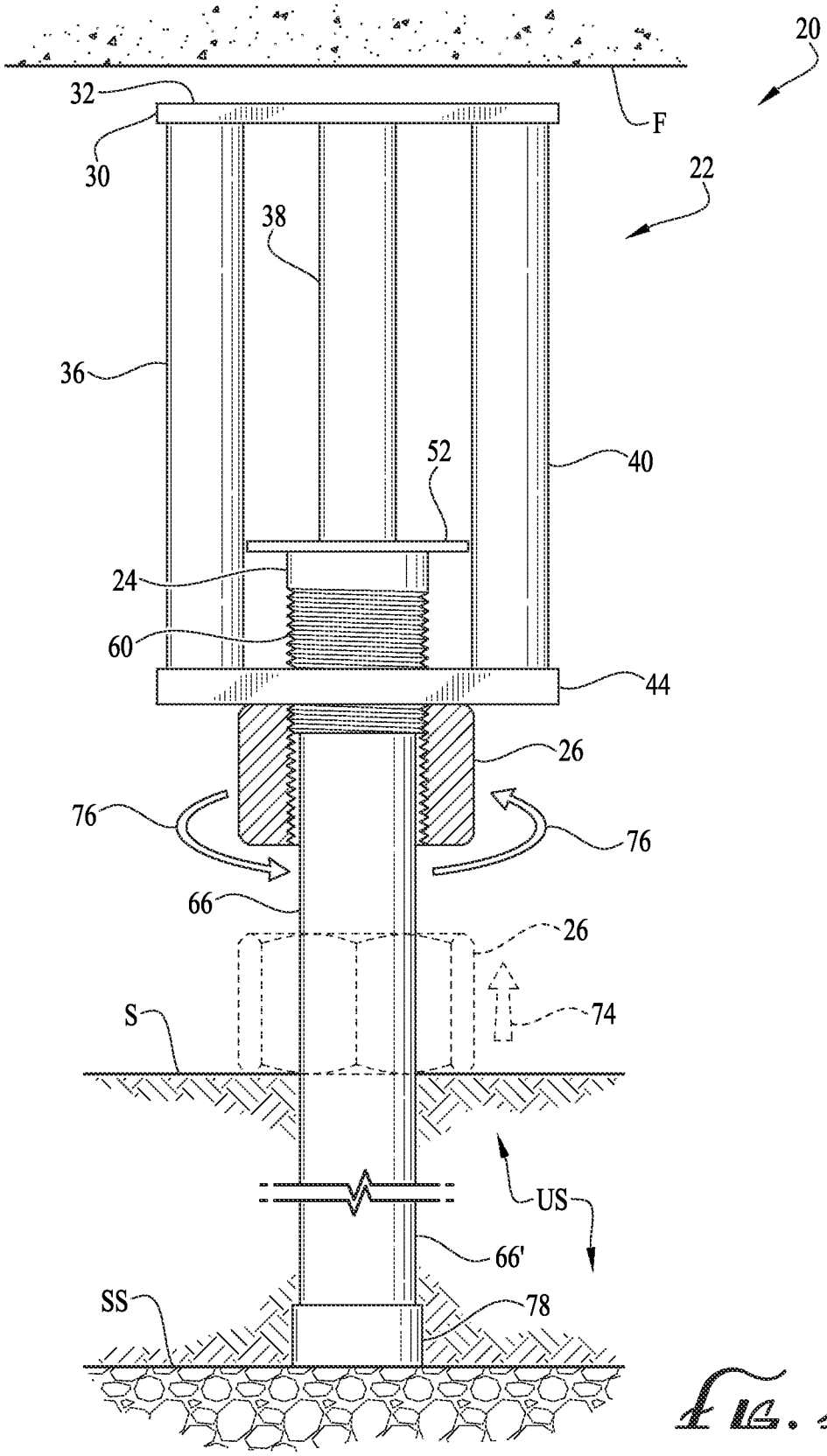
FIG. 4 is a side view of the adjustable foundation support bracket of FIG. 1, illustrating the foundation support bracket being assembled atop a pier and beneath the foundation of a structure.
Figure 5:
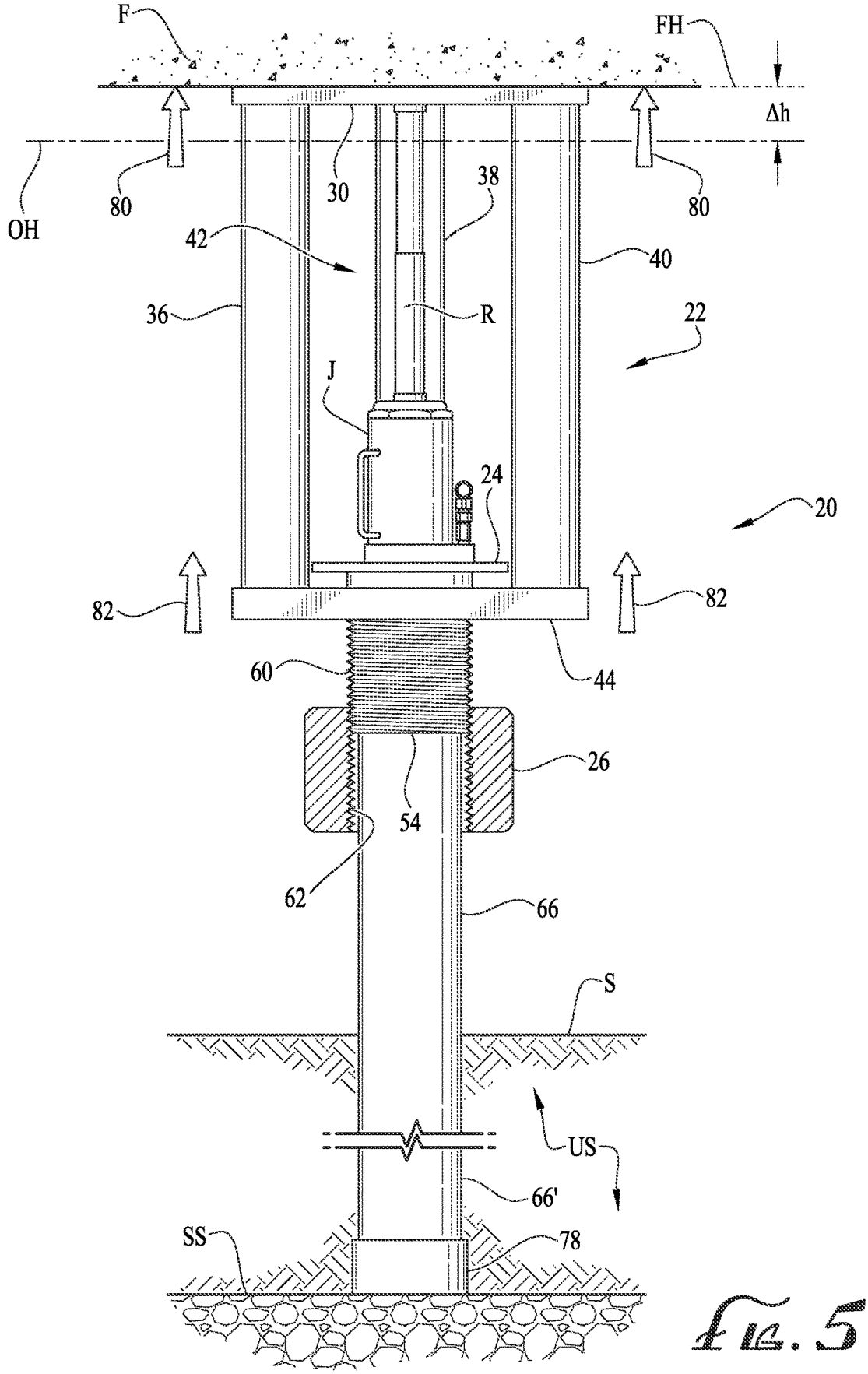
FIG. 5 is a side view of the adjustable foundation support bracket of FIG. 1, illustrating a jack lifting the bracket relative to the pier to raise the foundation level.

Looking briefly at an example pier structure, the illustrated pier 28 includes a plurality of aligned outer pier tubes 66 lined with a plurality of inner pier tubes 70 inserted within the outer pier tubes 66 and offset from the seams of the outer pier tubes 66 to create a strong pier structure. An end cap 78 (see FIG. 4) is placed at the very bottom end of the first outer pier tubes 66' driven into the soil. The outer pier tubes 66 may include button punch holes 72 or other fastening features to secure the outer pier tubes 66 to the inner pier tubes 70. As is known in industry, the weight of the foundation F is used to drive the pier 28 into the unstable soil US directly beneath the foundation, one segment of the pier 28 at a time, until stable soil SS is reached. Although the pier 28 is illustrated, in one or more embodiments, it is not a part of the invention, even though the present adjustable foundation support 20 rest atop the pier 28.

In this example embodiment, the height adjustment lock 26 is a single large nut 26 (e.g., a high-strength hex nut, flange nut, or similar) with no other height adjustment lock necessary (e.g., the nut is selected for strength and size to bear the load required, such that a second nut or second fastener is not required), where the single large nut 26 bears the entire load transmitted through the bracket 22 to the pier 28, via the pier cap 24. Other types of height adjustment locks can be used in one or more embodiments, such as a shaft collar, a pin arrangement, a welded collar, or other known means to bear the load. As seen in FIGS. 1 and 3, the hollow threaded extension 54 of the pier cap 24 is inserted into the through hole 46 with the jack support 52 positioned above the top surface 48 of the bottom plate 44 and the pier opening 64 positioned below the bottom surface 50 of the bottom plate 44. The pier opening 64 and the inner diameter of the hollow threaded extension 54 have a larger diameter than the end 68 of the pier 28 and the entire portion of the pier 28 inserted within the hollow threaded extension 54. The smallest diameter of the female thread 62 (i.e., the minor diameter) of the nut 26 is larger than the end 68 of the pier 28 and the entire portion of the pier 28 inserted within the hollow threaded extension 54, such that the top portion of the pier 28 can be inserted into the nut 26 with the nut 26 able to slide freely (or with little hinderance) up and down on that portion of the pier 28 (which is generally the uppermost outer pier tube 66 or an extension thereof). Further, the female thread 62 of the nut 26 is sized to threadably engage the male thread 60 of the hollow threaded extension 54; where when engaged, the nut 26 traps the bottom plate 44 between the jack support 52 of the pier cap 24 and the nut 26.

Looking now at FIGS. 4-7, the assembly of the present adjustable foundation support 20 is illustrated. As described above, the pier 28 is driven from the surface S into the soil S, through the unstable soil US, until the end cap 78 attached to the end of the lowermost outer pier tube 66' at least reaches stable soil SS (i.e., load bearing strata), using standard pier driving techniques known in industry. First the nut 26 (shown initially in phantom) is slide atop the pier 28 with the pier 28 inserted inside the nut 26. Then, the bracket 22 is slid atop the pier 28, with the pier 28 inserted through the hole 46 in the bottom plate 44 to position the end 68 of the pier 28 within the jack region 42 of the bracket 22.

Thereafter, perhaps supporting the bracket 22 with one hand, the hollow threaded extension 54 of the pier cap 24 inserted through the hole 46 and is placed atop the end 68 of the pier 28, with the pier 28 inserted within the hollow threaded extension 54 and the top end 68 of the pier 28 bearing against the bottom surface 50 of the jack support plate 44. Then, the nut 26 is slid up the pier 28 as indicated by arrow 74 and is hand-threaded to the male thread 60 of the hollow threaded extension 54 as indicated by arrows 76. The number of threads engaged should be sufficient to support the expected load of the jacking process (e.g., where 3 or more threads are engaged). The nut 26 can be hand-threaded until the top surface 32 of the top plate 30 is contacting the foundation F or just beneath the foundation F with a small gap therebetween. In one or more embodiments, the jack support plate 52 includes portions (such as the corners of a square plate or other protrusions) that will contact one or more of the columns 36, 38, 40 to prevent rotation of the pier cap 24 relative to the bracket 22, where rotation is prevented about the vertical axis (i.e., the axis parallel with the longitudinal axis of the pier 28, which should be substantially parallel with the direction of gravity).

Figure 6:
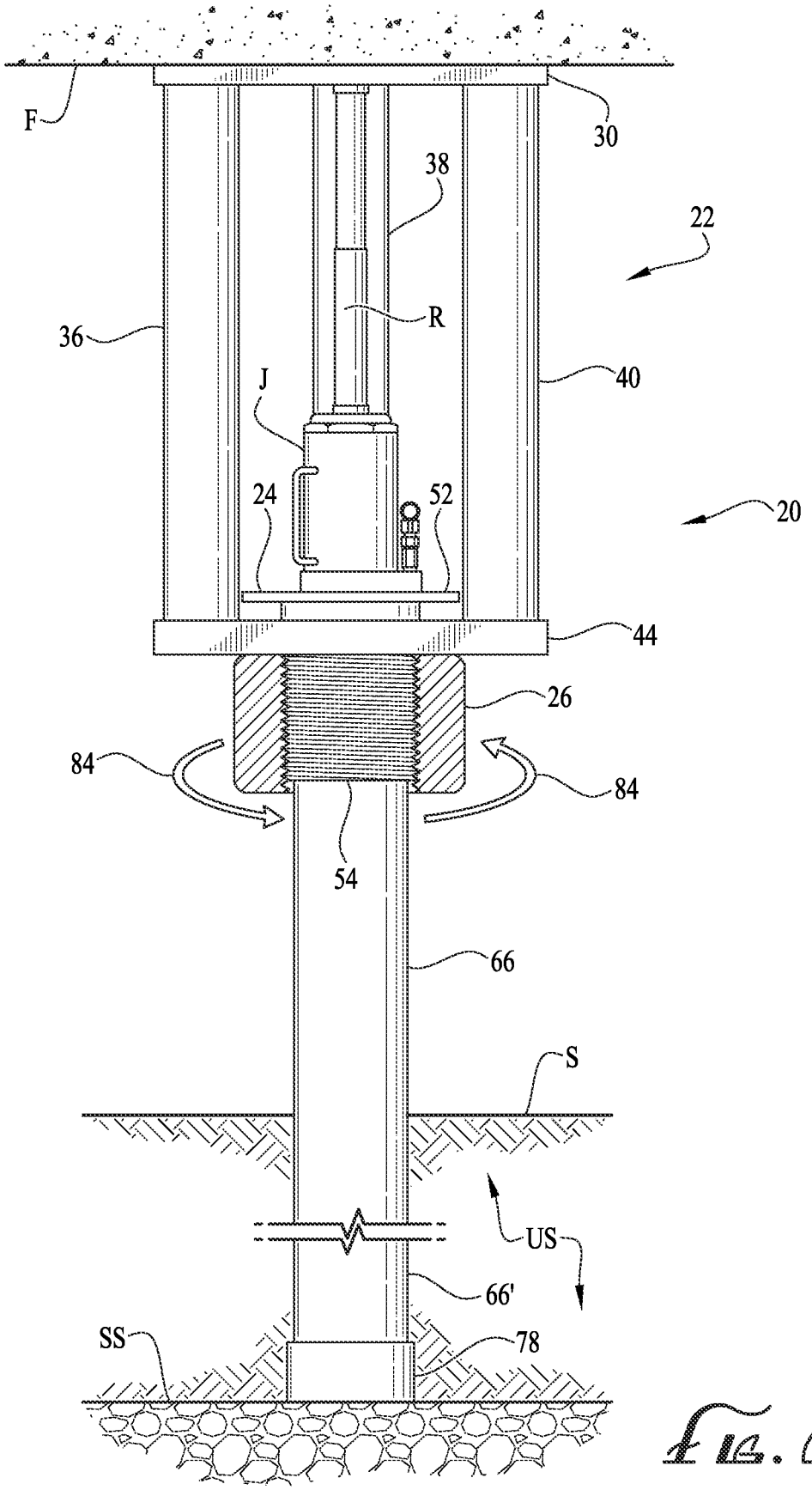
FIG. 6 is a side view of the adjustable foundation support bracket of FIG. 1, illustrating the height locking nut being threaded on to bear against the bottom of the bracket with the jack in place.
Figure 7:
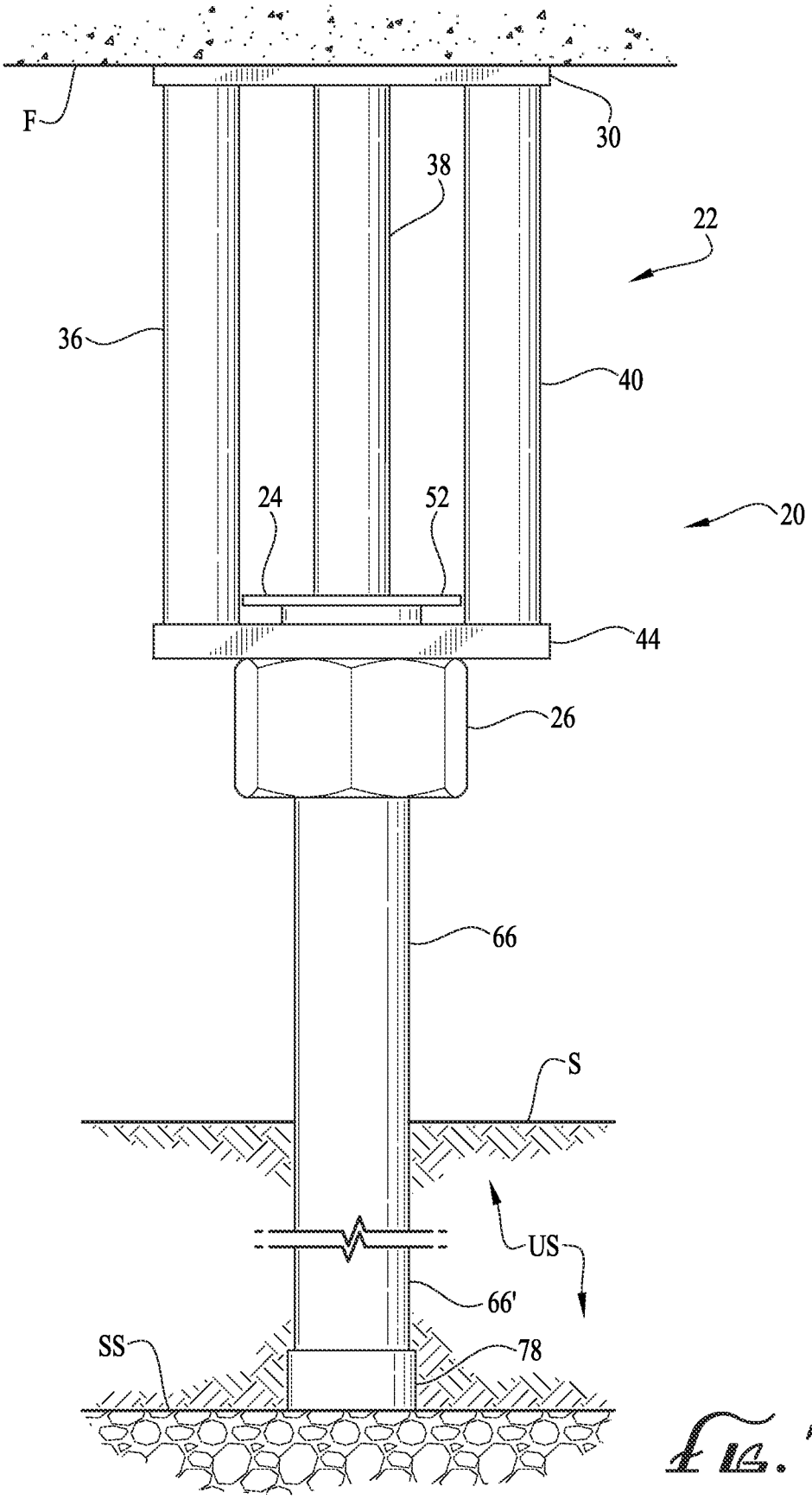
FIG. 7 is a side view of the adjustable foundation support bracket of FIG. 1, illustrating the height locking nut supporting the bracket in the final state of installation.

After the adjustable foundation support 20 is assembled atop the pier 28 and beneath the foundation F, the jack J (such as a hydraulic jack or other similar lifting device) can be positioned within the jack region 42, with the jack J supported from beneath by the jack support plate 52 and the ram R of the jack J extended to just touch the bottom surface 34 of the top plate 30. Thereafter, the jack J is actuated, such that the ram R pushes upward on the top plate 30 of the bracket 22 to move the bracket 22 and foundation upwards relative to the pier cap 24, nut 26, and pier 28, as indicated by arrows 82 (illustrating movement of the bracket 22) and arrows 80 (illustrating movement of the foundation as pushed up by the jack J through the bracket 22). After a number of jack J actuations (i.e., by hand pumping, by electric pump or the like), the foundation F is lifted a distance Δh, from the original height OH to the final height FH. Once the final height FH is obtained, the jacking process is halted and the jack J temporarily left in place to maintain the height. As illustrated in FIG. 6, with the jack J still in place, the nut 26 is further hand threaded (arrows 84) onto the hollow threaded extension 54, until the nut 26 contacts or is in close proximity of the bottom surface 50 of the bottom plate 44. Further torquing of the nut 26 by wrench may or may not be required.

Once the nut 26 is in position beneath the bottom plate 44, the hydraulic pressure of the jack J can be released, such that the ram R drops out of contact with the top plate 30. The weight of that portion of the foundation is not longer supported by the jack J, and is transitioned to the adjustable foundation support 20. Specifically, the top plate 30 directly contacts the foundation F and the load of the foundation F is transmitted downward to the bottom plate 44 through the columns 36, 38, 40. The bottom plate 44 directly rests upon the nut 26, such that the single nut 26 bears the entire load transmitted through the bracket 22. Particularly, the bearing surface of the nut 26 contacts the bottom surface 50 of the bottom plate 44 immediately surrounding the through hole 46. If required, a washer, flange, or other load distribution hardware can be placed between the nut 26 and the bottom plate 44. However, the nut 26 ultimately supports the entire load. Further, the entire load is transmitted from the nut 26 to the pier cap 24 via the threaded engagement. Because the pier cap 24 rests upon the end 68 of the pier 28, the entire load is transmitted to the pier 28, and ultimately, to stable soil SS.

Although the present adjustable foundation support 20 is illustrated as being installed atop a pier 28 that is driven to stable soil, the pier 28 can be supported nearer to or on the surface of the soil by concrete block or other foundational feature. Thus, the operation of the present adjustable foundation support 20 does not depend on the exact nature of the pier 28, and merely engages the top portion of a pier or other column-like structure protruding vertically from beneath the foundation.

The benefit of the present adjustable foundation support 20 is that the load of the foundation F is always centered or substantially centered on the pier 28. There is only one height adjustment lock 26 that holds the position of the bracket 22 relative to the pier cap 24, where the height adjustment lock 26 is centered overtop the pier 28. This avoids an undesirable bending moment on the bracket 22 and pier 28, which endangers their structural integrity. Devices with multiple off-center adjustment and locking means risk an unlevel installation that creates the bending moment. The present adjustable foundation support 20 is simple to install and includes few parts, yet is strong and long-lasting, eliminating many user and equipment errors introduced during installation.

Aspects of the present specification may also be described as follows:

1. An adjustable foundation support for changing a foundation height and transferring a foundation weight to a pier, the adjustable foundation support including a bracket having a top plate rigidly separated from a bottom plate by a plurality of columns and a jack region delineated between the top plate, the bottom plate, and between the columns, a pier cap opening being formed through the bottom plate; a pier cap having a jack support plate and an elongated pier sleeve, the elongated pier sleeve extending rigidly from a bottom surface of the jack support plate with a pier receiving opening situated distally, the elongated pier sleeve including an external thread therearound, the pier cap being configured to be placed through the opening of the bottom plate of the bracket with the jack support plate positioned within the jack region and the elongated pier sleeve extending through the opening; and a height locking nut selectively attached to the pier cap by threadable engagement to the elongated pier sleeve with the bottom plate of the bracket being situated between the jack support plate and the height locking nut; where, during a height adjustment procedure, the height locking nut is configured to be threaded onto the elongated pier sleeve to a desired position; and where, once located at the desired position, the height locking nut is configured to support the foundation weight through the bracket with the bottom plate bearing upon the height locking nut with a top end of the pier inserted through the pier receiving opening and situated within the pier sleeve.

2. The adjustable foundation support of embodiment 1 where plurality of columns includes a first column, a second column, and a third column each extending parallelly between and attached to both the top plate and the bottom plate, and arranged spaced apart in a triangular pattern on each of the top plate and the bottom plate, the pier cap opening being a hole centered on an incenter of the triangular pattern.

3. The adjustable foundation support of embodiments 1 or 2 where a threaded hole diameter of the height locking nut is larger than a pier diameter at the top end of the pier.

4. An adjustable foundation support for changing a height of a foundation and transferring at least a local portion of a foundation load to a pier, the adjustable foundation support including a bracket having a top plate rigidly attached to and separated from a bottom plate by a vertical support and a jack region delineated between the top plate and the bottom plate, a pier cap opening being formed through the bottom plate; a pier cap having a jack support and a pier sleeve, the pier sleeve extending rigidly from a bottom surface of the jack support with a pier receiving opening situated distally, the pier cap being configured to be placed through the opening of the bottom plate of the bracket with the jack support plate positioned within the jack region and the elongated pier sleeve extending through the opening; and a height adjustment lock selectively attached to the pier cap by the pier sleeve with the bottom plate of the bracket situated between the jack support plate and the height adjustment lock; where, in use, the height adjustment lock is configured to couple with the elongated pier sleeve located at a desired position; and where, once located at the desired position, the height adjustment lock is configured to completely support the local portion of the foundation load through the bracket with the bottom plate bearing upon the height adjustment lock with a top end of the pier inserted through the pier receiving opening and situated within the elongated pier sleeve.

5. The adjustable foundation support of embodiment 4 where the vertical support is a plurality of columns each extending between and attached to both the top plate and the bottom plate.

6. The adjustable foundation support of embodiments 4 or 5 where the plurality of columns are arranged in a spaced apart pattern on each of the top plate and the bottom plate such that the jack support of the pier cap is positioned between the plurality of columns with at least one of the plurality of columns configured to stop the rotation of the pier cap when the jack support contacts the at least one of the plurality of columns in mechanical interference.

7. The adjustable foundation support of any one of embodiments 4-6 where the vertical support comprises a first column, a second column, and a third column each extending between and attached to both the top plate and the bottom plate, and arranged spaced apart in a triangular pattern on each of the top plate and the bottom plate, the pier cap opening being a hole centered on an incenter of the triangular pattern.

8. The adjustable foundation support of any one of embodiments 4-7 where the height adjustment lock is a height locking nut and the elongated pier sleeve includes an exterior thread configured to threadably receive the height locking nut to the desired position.

9. The adjustable foundation support of any one of embodiments 4-8 where, in use, the jack support is configured to support thereon a jack within the jack region with the jack bearing upon an underside of the top plate with a topside of the top plate configured to bear against the foundation situated thereabove as the jack is actuated upwardly, the top plate of the bracket is configured to move away from the jack support of the pier cap from an initial position to the desired position as the jack is actuated upwardly, such that the height adjustment lock can be located on the elongated pier sleeve to the desired position, the bottom plate of the bracket configured to bear against the height adjustment lock when the jack is removed to hold the desired position.

10. The adjustable foundation support of any one of embodiments 4-9 where the height adjustment lock is configured to be longitudinally movable along the elongated pier sleeve to the desired position.

11. A method of changing a height of a foundation and supporting the foundation on a pier, including providing an adjustable foundation support comprising a bracket having a top plate rigidly attached to and separated from a bottom plate by a vertical support and a jack region delineated between the top plate and the bottom plate, a pier cap opening being formed through the bottom plate; a pier cap having a jack support plate and an elongated pier sleeve, the elongated pier sleeve extending rigidly from a bottom surface of the jack support plate with a pier receiving opening situated distally, the elongated pier sleeve including an external thread therearound; a height adjustment lock selectively attached to the pier cap by the elongated pier sleeve with the bottom plate of the bracket situated between the jack support plate and the height adjustment lock; installing the height adjustment lock, the bracket, and the pier cap on the pier, where the elongated pier sleeve of the pier cap is positioned within the pier cap opening to position the jack support plate within the jack region of the bracket; placing a jack atop the jack support plate within the jack region; actuating the jack such that the jack bears upon the top plate to lift the bracket and foundation relative to the pier cap to a desired position; fastening the height adjustment lock to the elongated pier sleeve; and removing the jack from the jack region such that a load of the foundation is completely supported by the height adjustment lock.

12. The method of embodiment 11 where the vertical support is a plurality of columns each extending between and attached to both the top plate and the bottom plate.

13. The method of embodiments 11 or 12 where the plurality of columns are arranged in a spaced apart pattern on each of the top plate and the bottom plate such that the jack support of the pier cap is positioned between the plurality of columns with at least one of the plurality of columns configured to stop the rotation of the pier cap when the jack support contacts the at least one of the plurality of columns in mechanical interference.

14. The method of any one of embodiments 11-13 where the vertical support comprises a first column, a second column, and a third column each extending between and attached to both the top plate and the bottom plate, and arranged spaced apart in a triangular pattern on each of the top plate and the bottom plate, the pier cap opening being a hole centered on an incenter of the triangular pattern.

15. The method of any one of embodiments 11-14 where the height adjustment lock is a height locking nut and the elongated pier sleeve includes an exterior thread configured to threadably receive the height locking nut to the desired position.

16. The method of any one of embodiments 11-15 where, in use, the jack support is configured to support thereon a jack within the jack region with the jack bearing upon an underside of the top plate with a topside of the top plate configured to bear against the foundation situated thereabove as the jack is actuated upwardly, the top plate of the bracket is configured to move away from the jack support of the pier cap from an initial position to the desired position as the jack is actuated upwardly, such that the height adjustment lock can be located on the elongated pier sleeve to the desired position, the bottom plate of the bracket configured to bear against the height adjustment lock when the jack is removed to hold the desired position.

In closing, it is to be understood that, although aspects of the present specification are highlighted by referring to specific embodiments, one skilled in the art will readily appreciate that these disclosed embodiments are only illustrative of the principles of the subject matter disclosed herein. The specific embodiments are not intended to be exhaustive or to limit the invention to the precise forms disclosed. Therefore, it should be understood that the disclosed subject matter is in no way limited to a particular compound, composition, article, apparatus, methodology, protocol, and/or reagent, etc., described herein, unless expressly stated as such. In addition, those of ordinary skill in the art will recognize that certain changes, modifications, permutations, alterations, additions, subtractions and sub-combinations thereof can be made in accordance with the teachings herein without departing from the spirit of the present specification. It is therefore intended that the scope of the invention is not to be limited by this detailed description. Furthermore, it is intended that the following appended claims and claims hereafter introduced are interpreted to include all such changes, modifications, permutations, alterations, additions, subtractions and sub-combinations as are within their true spirit and scope.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified, thus fulfilling the written description of all Markush groups used in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement and support for the phrases "consisting essentially of" and "consisting of."

Lastly, the terminology used herein is for the purpose of describing particular embodiments only and is not intended to limit the scope of the present invention, which is defined solely by the claims. Accordingly, the present invention is not limited to that precisely as shown and described.

What is claimed is:

1. An adjustable foundation support for changing a foundation height and transferring a foundation weight to a pier, the adjustable foundation support comprising:

a bracket having a top plate rigidly separated from a bottom plate by a plurality of columns and a jack region delineated between the top plate, the bottom plate, and between the columns, a pier cap opening being formed through the bottom plate;

a pier cap having a jack support plate and an elongated pier sleeve, the elongated pier sleeve extending rigidly from a bottom surface of the jack support plate with a pier receiving opening situated distally, the elongated pier sleeve including an external thread therearound, the pier cap being configured to be placed through the opening of the bottom plate of the bracket with the jack support plate positioned within the jack region and the elongated pier sleeve extending through the opening; and a height locking nut selectively attached to the pier cap by threadable engagement to the elongated pier sleeve with the bottom plate of the bracket being situated between the jack support plate and the height locking nut;

wherein, during a height adjustment procedure, the height locking nut is configured to be threaded onto the elongated pier sleeve to a desired position;

and wherein, once located at the desired position, the height locking nut is configured to support the foundation weight through the bracket with the bottom plate bearing upon the height locking nut with a top end of the pier inserted through the pier receiving opening and situated within the pier sleeve.

2. The adjustable foundation support of claim 1 wherein the plurality of columns comprises a first column, a second column, and a third column each extending parallelly between and attached to both the top plate and the bottom plate, and arranged spaced apart in a triangular pattern on each of the top plate and the bottom plate, the pier cap opening being a hole centered on an incenter of the triangular pattern.

3. The adjustable foundation support of claim 1 wherein a threaded hole diameter of the height locking nut is larger than a pier diameter at the top end of the pier.

4. An adjustable foundation support for changing a height of a foundation and transferring at least a local portion of a foundation load to a pier, the adjustable foundation support comprising:

a bracket having a top plate rigidly attached to and separated from a bottom plate by a vertical support and a jack region delineated between the top plate and the bottom plate, a pier cap opening being formed through the bottom plate;

a pier cap having a jack support and a pier sleeve, the pier sleeve extending rigidly from a bottom surface of the jack support with a pier receiving opening situated distally, the pier cap being configured to be placed through the opening of the bottom plate of the bracket with the jack support plate positioned within the jack region and the elongated pier sleeve extending through the opening; and a height adjustment lock selectively attached to the pier cap by the pier sleeve with the bottom plate of the bracket situated between the jack support plate and the height adjustment lock;

wherein, in use, the height adjustment lock is configured to couple with the elongated pier sleeve located at a desired position;

and wherein, once located at the desired position, the height adjustment lock is configured to completely support the local portion of the foundation load through the bracket with the bottom plate bearing upon the height adjustment lock with a top end of the pier inserted through the pier receiving opening and situated within the elongated pier sleeve.

5. The adjustable foundation support of claim 4 wherein the vertical support is a plurality of columns each extending between and attached to both the top plate and the bottom plate.

6. The adjustable foundation support of claim 5 wherein the plurality of columns are arranged in a spaced apart pattern on each of the top plate and the bottom plate such that the jack support of the pier cap is positioned between the plurality of columns with at least one of the plurality of columns configured to stop the rotation of the pier cap when the jack support contacts the at least one of the plurality of columns in mechanical interference.

7. The adjustable foundation support of claim 4 wherein the vertical support comprises a first column, a second column, and a third column each extending between and attached to both the top plate and the bottom plate, and arranged spaced apart in a triangular pattern on each of the top plate and the bottom plate, the pier cap opening being a hole centered on an incenter of the triangular pattern.

8. The adjustable foundation support of claim 4 wherein the height adjustment lock is a height locking nut and the elongated pier sleeve includes an exterior thread configured to threadably receive the height locking nut to the desired position.

9. The adjustable foundation support of claim 4 wherein, in use, the jack support is configured to support thereon a jack within the jack region with the jack bearing upon an underside of the top plate with a topside of the top plate configured to bear against the foundation situated thereabove as the jack is actuated upwardly, the top plate of the bracket is configured to move away from the jack support of the pier cap from an initial position to the desired position as the jack is actuated upwardly, such that the height adjustment lock can be located on the elongated pier sleeve to the desired position, the bottom plate of the bracket configured to bear against the height adjustment lock when the jack is removed to hold the desired position.

10. The adjustable foundation support of claim 4 wherein the height adjustment lock is configured to be longitudinally movable along the elongated pier sleeve to the desired position.

11. A method of changing a height of a foundation and supporting the foundation on a pier, the method comprising:

providing an adjustable foundation support comprising:

a bracket having a top plate rigidly attached to and separated from a bottom plate by a vertical support and a jack region delineated between the top plate and the bottom plate, a pier cap opening being formed through the bottom plate;

a pier cap having a jack support plate and an elongated pier sleeve, the elongated pier sleeve extending rigidly from a bottom surface of the jack support plate with a pier receiving opening situated distally, the elongated pier sleeve including an external thread therearound;

a height adjustment lock selectively attached to the pier cap by the elongated pier sleeve with the bottom plate of the bracket situated between the jack support plate and the height adjustment lock;

installing the height adjustment lock, the bracket, and the pier cap on the pier, where the elongated pier sleeve of the pier cap is positioned within the pier cap opening to position the jack support plate within the jack region of the bracket;

placing a jack atop the jack support plate within the jack region;

actuating the jack such that the jack bears upon the top plate to lift the bracket and foundation relative to the pier cap to a desired position;

fastening the height adjustment lock to the elongated pier sleeve; and removing the jack from the jack region such that a load of the foundation is completely supported by the height adjustment lock.

12. The method of claim 11 wherein the vertical support is a plurality of columns each extending between and attached to both the top plate and the bottom plate.

13. The method of claim 12 wherein the plurality of columns are arranged in a spaced apart pattern on each of the top plate and the bottom plate such that the jack support of the pier cap is positioned between the plurality of columns with at least one of the plurality of columns configured to stop the rotation of the pier cap when the jack support contacts the at least one of the plurality of columns in mechanical interference.

14. The method of claim 11 wherein the vertical support comprises a first column, a second column, and a third column each extending between and attached to both the top plate and the bottom plate, and arranged spaced apart in a triangular pattern on each of the top plate and the bottom plate, the pier cap opening being a hole centered on an incenter of the triangular pattern.

15. The method of claim 11 wherein the height adjustment lock is a height locking nut and the elongated pier sleeve includes an exterior thread configured to threadably receive the height locking nut to the desired position.

16. The method of claim 11 wherein, in use, the jack support is configured to support thereon a jack within the jack region with the jack bearing upon an underside of the top plate with a topside of the top plate configured to bear against the foundation situated thereabove as the jack is actuated upwardly, the top plate of the bracket is configured to move away from the jack support of the pier cap from an initial position to the desired position as the jack is actuated upwardly, such that the height adjustment lock can be located on the elongated pier sleeve to the desired position, the bottom plate of the bracket configured to bear against the height adjustment lock when the jack is removed to hold the desired position.

* * * * *